US005893503A

United States Patent [19]

Jean

[11] Patent Number: 5,893,503

[45] Date of Patent: Apr. 13, 1999

[54] NON-SLIPPING SHOULDER STRAP ASSEMBLY

[76] Inventor: Antoine Jean, 30 Hamilton Rd., Scarsdale, N.Y. 10583

[21] Appl. No.: 08/911,096

[22] Filed: Aug. 14, 1997

[51] Int. Cl.[6] ..... A45F 3/02

[52] U.S. Cl. ..... 224/626; 224/610; 224/617; 224/625; 224/264

[58] Field of Search ..... 224/153, 578, 224/579, 580, 600, 606, 613, 623, 624, 625, 626, 627, 637, 640, 645, 646, 647, 264, 257, 258, 614–622, 911

[56] References Cited

U.S. PATENT DOCUMENTS

| | | | |
|---|---|---|---|
| 240,151 | 4/1881 | Lambert | 224/608 |
| 1,470,334 | 10/1923 | Stensgaard et al. | 224/608 |
| 1,601,963 | 10/1926 | Arth | 224/911 |
| 2,037,132 | 4/1936 | Hoyt | 224/623 |
| 3,225,983 | 12/1965 | Majka | 224/610 |
| 4,793,533 | 12/1988 | Yang | 224/623 |
| 4,878,606 | 11/1989 | Miller | 224/625 |
| 5,119,910 | 6/1992 | Heggeland | 224/620 |
| 5,318,084 | 6/1994 | Jackson | 224/264 |
| 5,566,871 | 10/1996 | Weintraub | 224/264 |
| 5,603,441 | 2/1997 | Easter | 224/647 |

*Primary Examiner*—Allan N. Shoap
*Assistant Examiner*—Gregory M. Vidovich

[57] ABSTRACT

A new non-slipping shoulder strap assembly for helping a users to securely carry bags on their shoulder. The inventive device includes an elongate shoulder strap for resting on a first shoulder of a wearer and having a shoulder resting portion and a pair of end portions to which a load may be attached. An elongate armpit strap is coupled to the shoulder strap resting portion and extends around the torso under a second shoulder. A waist strap is coupled to the shoulder strap end portions and extends around a waist underneath the second shoulder.

10 Claims, 3 Drawing Sheets

NON-SLIPPING SHOULDER STRAP ASSEMBLY

BACKGROUND OF THE INVENTION

1. Field of the Invention

The present invention relates to carrying straps and more particularly pertains to a new non-slipping shoulder strap assembly for helping a user to securely carry bags on their shoulder.

2. Description of the Prior Art

The use of carrying straps is known in the prior art. More specifically, carrying straps heretofore devised and utilized are known to consist basically of familiar, expected and obvious structural configurations, notwithstanding the myriad of designs encompassed by the crowded prior art which have been developed for the fulfillment of countless objectives and requirements.

Known prior art carrying straps include U.S. Pat. No. 5,038,984; U.S. Pat. No. 5,429,288; U.S. Pat. No. Des. 328,188; U.S. Pat. No. 5,400,935; U.S. Pat. No. 5,411,194; and U.S. Pat. No. 5,415,332.

While these devices fulfill their respective, particular objectives and requirements, the aforementioned patents do not disclose a new non-slipping shoulder strap assembly. The inventive device includes an elongate shoulder strap for resting on a first shoulder of a wearer and having a shoulder resting portion and a pair of end portions to which a load may be attached. An elongate armpit strap is coupled to the shoulder strap resting portion and extends around the torso under a second shoulder. A waist strap is coupled to the shoulder strap end portions and extends around a waist underneath the second shoulder.

In these respects, the non-slipping shoulder strap assembly according to the present invention substantially departs from the conventional concepts and designs of the prior art, and in so doing provides an apparatus primarily developed for the purpose of helping a users to securely carry bags on their shoulder.

SUMMARY OF THE INVENTION

In view of the foregoing disadvantages inherent in the known types of carrying straps now present in the prior art, the present invention provides a new non-slipping shoulder strap assembly construction wherein the same can be utilized for helping a user to securely carry bags on their shoulder.

The general purpose of the present invention, which will be described subsequently in greater detail, is to provide a new non-slipping shoulder strap assembly apparatus and method which has many of the advantages of the carrying straps mentioned heretofore and many novel features that result in a new non-slipping shoulder strap assembly which is not anticipated, rendered obvious, suggested, or even implied by any of the prior art carrying straps, either alone or in any combination thereof.

To attain this, the present invention generally comprises an elongate shoulder strap for resting on a first shoulder of a wearer and having a shoulder resting portion and a pair of end portions to which a load may be attached. An elongate armpit strap is coupled to the shoulder strap resting portion and extends around the torso under a second shoulder. A waist strap is coupled to the shoulder strap end portions and extends around a waist underneath the second shoulder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new non-slipping shoulder strap assembly apparatus and method which has many of the advantages of the carrying straps mentioned heretofore and many novel features that result in a new non-slipping shoulder strap assembly which is not anticipated, rendered obvious, suggested, or even implied by any of the prior art carrying straps, either alone or in any combination thereof.

It is another object of the present invention to provide a new non-slipping shoulder strap assembly which may be easily and efficiently manufactured and marketed.

It is a further object of the present invention to provide a new non-slipping shoulder strap assembly which is of a durable and reliable construction.

An even further object of the present invention is to provide a new non-slipping shoulder strap assembly which is susceptible of a low cost of manufacture with regard to both materials and labor, and which accordingly is then susceptible of low prices of sale to the consuming public, thereby making such non-slipping shoulder strap assembly economically available to the buying public.

Still yet another object of the present invention is to provide a new non-slipping shoulder strap assembly which provides in the apparatuses and methods of the prior art some of the advantages thereof, while simultaneously overcoming some of the disadvantages normally associated therewith.

Still another object of the present invention is to provide a new non-slipping shoulder strap assembly for helping a user to securely carry bags on their shoulder.

Yet another object of the present invention is to provide a new non-slipping shoulder strap assembly which includes an elongate shoulder strap for resting on a first shoulder of a wearer and having a shoulder resting portion and a pair of end portions to which a load may be attached. An elongate armpit strap is coupled to the shoulder strap resting portion and extends around the torso under a second shoulder. A waist strap is coupled to the shoulder strap end portions and extends around a waist underneath the second shoulder.

Still yet another object of the present invention is to provide a new non-slipping shoulder strap assembly that helps resolve the problem of heavy shoulder bags slipping off of the shoulder of a wearer.

Even still another object of the present invention is to provide a new non-slipping shoulder strap assembly that helps reduce the possibility of theft of the bag from the body of the wearer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
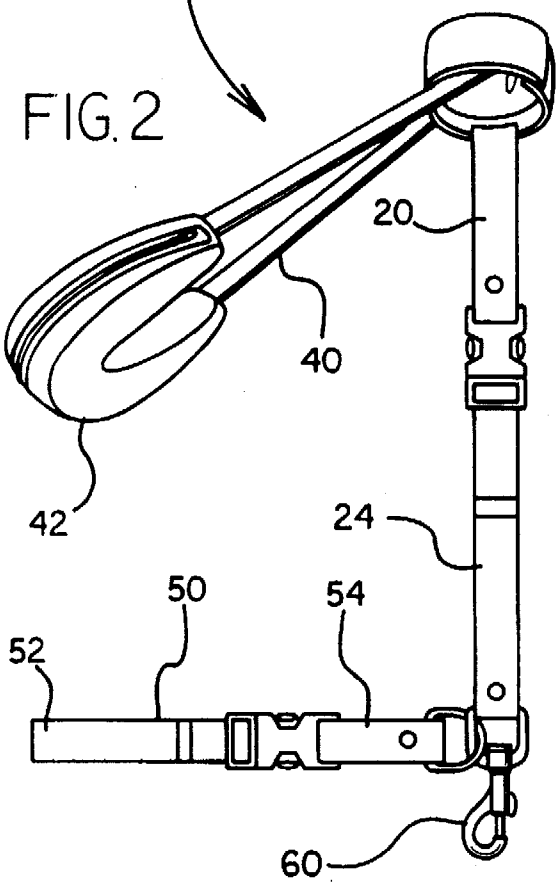
FIG. 2 is a side view of the present invention.

With reference now to the drawings, and in particular to FIGS. 1 through 5 thereof, a new non-slipping shoulder strap assembly embodying the principles and concepts of the present invention and generally designated by the reference numeral 10 will be described.

As best illustrated in FIGS. 1 through 5, the non-slipping shoulder strap assembly 10 generally comprises an elongate shoulder strap 20 for resting on a first shoulder of the wearer and having a shoulder resting portion 22 and a pair of end portions 24 to which a load 1 may be attached. An elongate armpit strap 40 is coupled to the shoulder resting portion 22 and extends around the torso of the wearer under a second shoulder. A waist strap 50 is coupled to the shoulder strap end portions 24 and extends around a waist of the wearer underneath the second shoulder.

Figure 1:
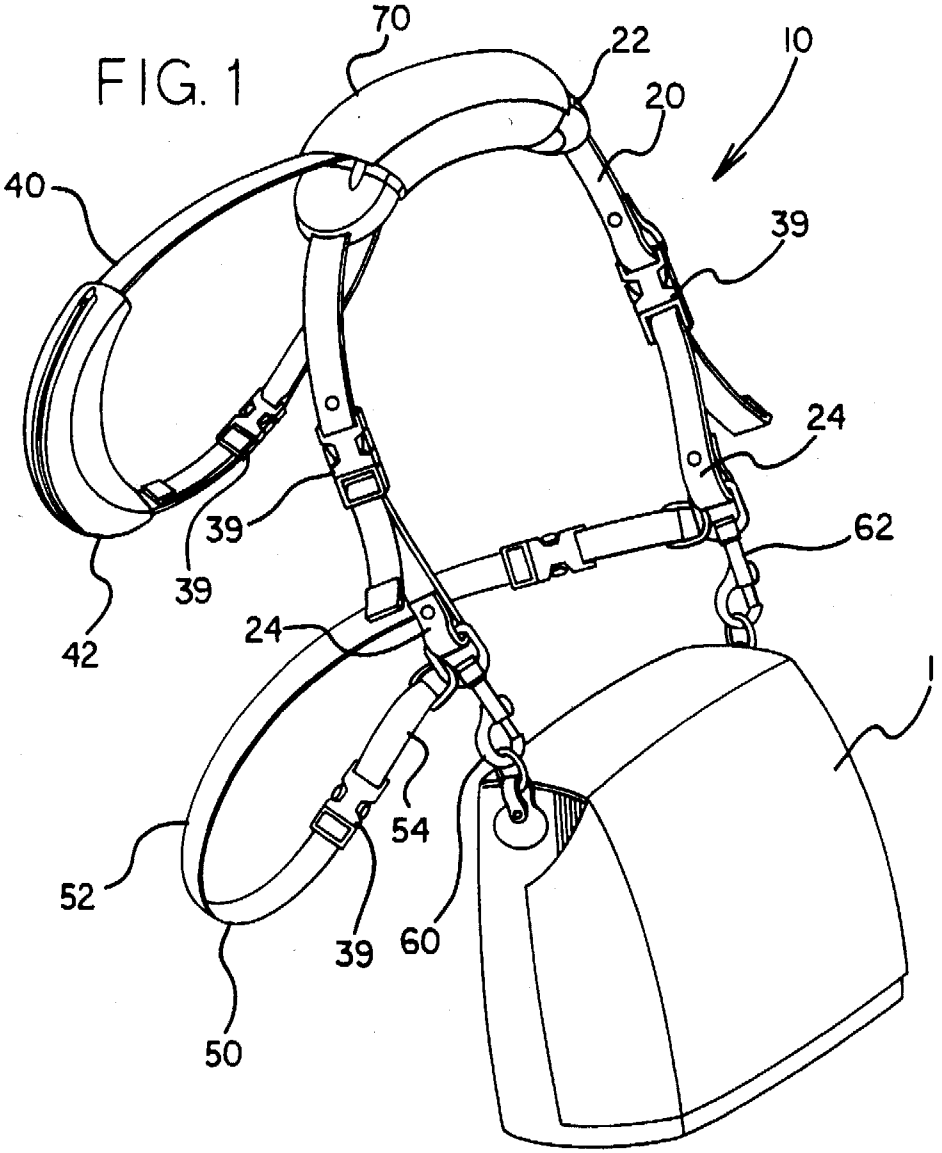
FIG. 1 is a perspective view of a new non-slipping shoulder strap assembly with an attached bag with one of the shoulder straps extending behind the shoulder pad portion for coupling with an opposite side thereof. (Note FIG. 4.).

As illustrated in FIG. 1, the shoulder strap 20 has a shoulder resting portion 22 positioned between a pair of opposite shoulder strap end portions 24. The shoulder resting portion 22 is designed to rest on the first shoulder, which is preferably located on the same side of the body of the wearer as the load 1 to be carried. Also preferably, the shoulder resting portion 22 is detachably attached to each shoulder strap end portion 24.

Preferably, the length of the shoulder strap 20 is adjustably extendible. Ideally, as shown in FIG. 1, an adjustment slide clip 39 permits adjustment of the effective length of each shoulder strap end portion 24 thereby providing adjustable extension of the shoulder strap 20. The adjustment slide clip 39 is designed such that an end of a shoulder strap end portion 24 opposite a load attachment means 60, 62 is looped around a buckle and back into contact with itself such that it is held from slipping by friction.

Preferably, the shoulder resting portion 22 is detachably attached to each shoulder strap end portion 24. Ideally, the adjustment slide clips 39 provide for the detachable attachment of the shoulder resting portion 22 to the shoulder strap end portions 24.

Figure 4:
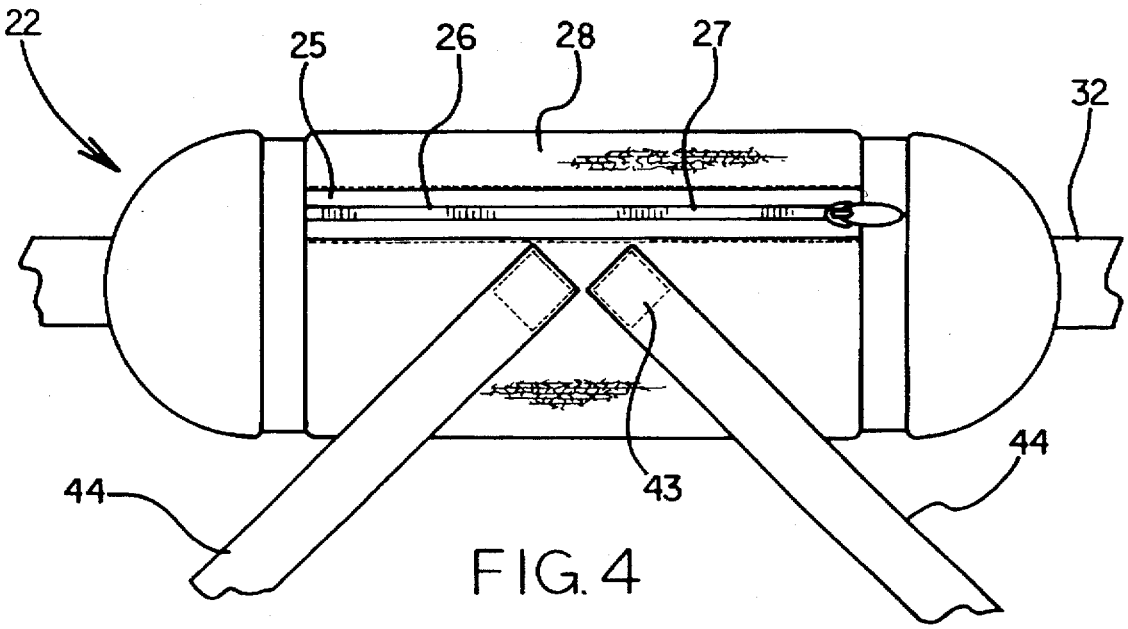
FIG. 4 is a top view of a broken away portion of the shoulder strap particularly illustrating the shoulder pad without the wrap.

Preferably, the shoulder resting portion 22 includes a pocket 25. Ideally, as shown in FIG. 4, the shoulder resting portion upper surface 28 has a closeable opening 26 into the interior of the pocket 25. Even more ideally, the opening 26 is closeable with a zipper 27. The shoulder resting portion lower surface 29 rests on the first shoulder of the wearer.

Figure 5:
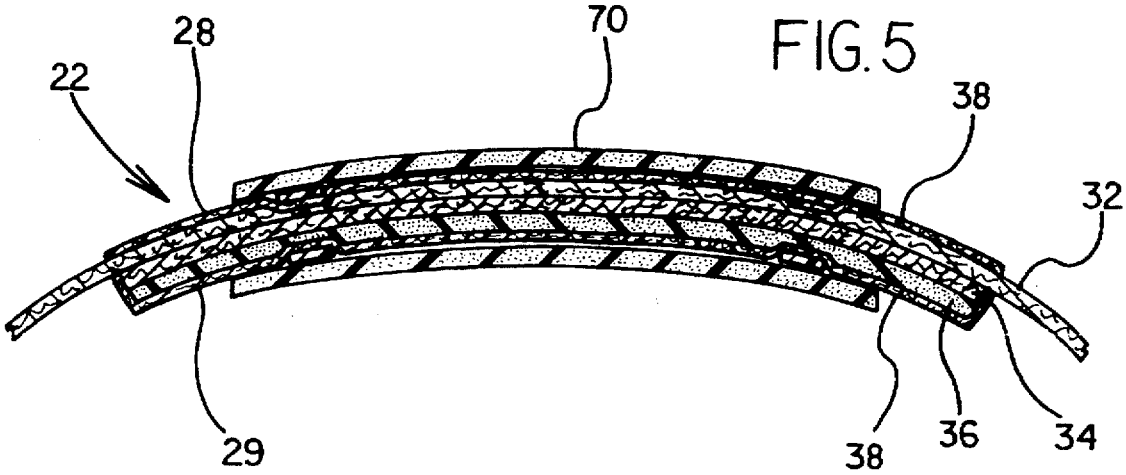
FIG. 5 is a sectional view of the shoulder pad portion of the invention.

Ideally, as illustrated in FIG. 5, the shoulder resting portion 22 consists of a strap 32. Coupled to the bottom of the strap 32 is a first layer 34 made of firm padding such as relatively hard foam rubber. Coupled to the bottom of the first layer 34 is a second layer 36 made of soft padding such as relatively soft foam rubber. Surrounding the strap 32 and first and second layers 34, 36 is a covering 38 made of a durable material such as nylon.

As seen in FIGS. 1 and 5, a shoulder wrap member 70 is disposed around the shoulder resting portion 22 to provide additional padding. Ideally, the shoulder wrap member 70 is detachably attached to the shoulder resting portion 22 by a fastener such as Velcro or a zipper.

The armpit strap 40 is designed to extend around the torso underneath the second shoulder of the wearer to assist in keeping the shoulder resting portion 22 from sliding off of the first shoulder of the wearer. The armpit strap 40 has an armpit resting portion 42 positioned between a pair of opposite armpit strap end portions 44 which are coupled to the shoulder resting portion 22. Preferably, the armpit resting portion 42 is detachably attached to one of the armpit strap end portions 44. Preferably, the armpit resting portion 42 has an inner surface 48 and an outer surface 49. The inner surface 48 abuts against the torso of the wearer.

Figure 3:
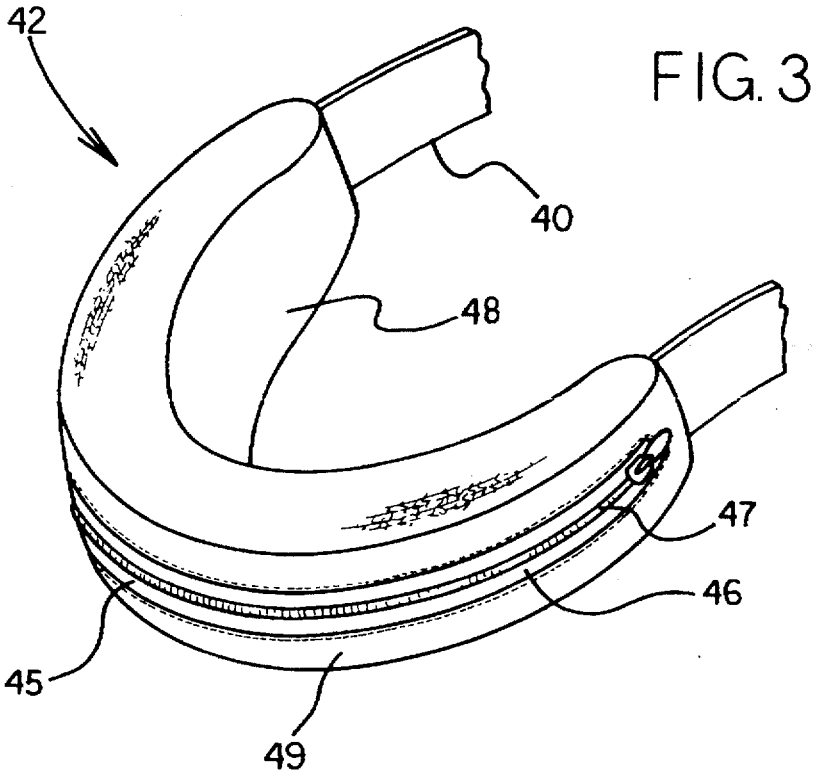
FIG. 3 is a perspective view of a broken away portion of the shoulder strap particularly illustrating the underarm pad.

Preferably, the armpit resting portion 42 has a pocket 45 disposed within it. Ideally, as shown in FIG. 3, the armpit resting portion has an outer surface 49 with a closeable opening 46 into the armpit resting portion pocket 45. Even more ideally, the opening 46 is closeable with a zipper 47.

Preferably, the length of the armpit strap 40 is adjustably extendible. Ideally, the effective length of armpit strap end portion 44 is adjustably extendible, such as may be provided by means of an adjustment slide clip 39. Also preferably, as illustrated in FIG. 4, the armpit strap end portions 44 are detachably attached to the shoulder resting portion upper surface 28 by a detachable fastening means 43. For example, a hook and loop fastening means such as is sold under the trade name Velcro may be employed as the fastening means.

The waist strap 50 is designed to be extended around the waist of the wearer under the second shoulder to assist in keeping the load 1 close to the body of the wearer. The waist strap 50 includes a waist resting portion 52 positioned between a pair of opposite waist strap end portions 54. Each waist strap end portion 54 is coupled to a shoulder strap end portion 24.

Preferably, the length of the waist strap 50 is adjustably extendible. Ideally, each waist strap end portion 54 is mounted to the waist strap in a manner permitting the effective length of the end portion 54 to be extended or contracted according to the size of the wearer's waist. Also preferably, the waist resting portion 52 is detachably attached to each waist strap end portion 54. Adjustment slide clips 39 may be used to achieve both extendibility of the waist strap 50 and detachable attachment of the waist resting portion 52 to the waist strap end portions 54.

A first load attachment means 60 is coupled to a shoulder strap end portion 24 for attaching a load 1 to the shoulder strap end portion 24. Likewise, a second load attachment means 62 for attaching a load 1 to a shoulder strap end portion 24 is coupled to the other shoulder strap end portion 24.

Ideally, as illustrated in FIG. 1, the shoulder strap assembly 10 includes a bag 1. The bag 1 is coupled to one shoulder strap end portion 24 by the first load attachment means 60 and to the other shoulder strap end portion 24 by the second load attachment means 62. In such an embodiment, the bag 1 forms a portion of a loop of the shoulder strap 20 and also forms a portion of a loop of the waist strap 50 around the wearer's body.

In use, the shoulder strap resting portion 22 is placed over the first shoulder of the wearer. The armpit strap 40 is attached to the shoulder strap resting portion 22 and extended around the torso underneath the second shoulder of the wearer, with the armpit resting portion 42 beneath the underarm of the wearer. The waist strap 50 is attached to the shoulder strap end portions 24 and extended around the waist of the wearer under the second shoulder. A load 1 such as a bag 1 is attached to the first and second load attachment means 60, 62.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoulder strap assembly for carrying a load, comprising:

an elongate shoulder strap for resting on a shoulder, said shoulder strap having a pair of opposite end portions and a shoulder resting portion for resting on a first shoulder, said shoulder strap being adjustably extendible, said shoulder resting portion being positioned between said shoulder strap end portions;

wherein said shoulder strap has a pair of opposite end portions, said shoulder resting portion being detachably attached to each said shoulder strap end portion;

wherein at least one of said shoulder strap end portions is adjustably extendible;

an elongate armpit strap for extending around a torso underneath a second shoulder, said armpit strap having a pair of opposite end portions and an armpit resting portion, said armpit strap being adjustably extendible, each said armpit strap end portion being coupled to said shoulder strap resting portion, said armpit resting portion being positioned between said armpit strap end portions;

an elongate waist strap for extending around a waist underneath the second shoulder, said waist strap having a pair of opposite end portions and a waist resting portion, each said waist strap end portion being coupled to a respective one of said shoulder strap end portions, said waist strap being adjustably extendible, said waist resting portion being positioned between said waist strap end portions;

a first load attachment means for attaching a load to one of said shoulder strap end portions;

a second load attachment means for attaching a load to the other of said shoulder strap end portions; and a shoulder wrap member being disposed around said shoulder resting portion, said shoulder wrap member being for providing additional padding around said shoulder resting portion.

2. The shoulder strap assembly of claim 1, wherein said shoulder resting portion has an upper and a lower surface, said shoulder resting portion having a pocket therein, said shoulder resting portion upper surface having a closeable opening into said shoulder resting portion pocket; and said shoulder resting portion lower surface being for resting on a first shoulder.

3. The shoulder strap assembly of claim 2, wherein each said armpit strap end portion is detachably attached to said shoulder strap resting portion upper surface.

4. The shoulder strap assembly of claim 1, wherein said armpit resting portion is detachably attached to one of said armpit strap end portions.

5. The shoulder strap assembly of claim 4, wherein at least one of said armpit strap end portions is adjustably extendible.

6. The shoulder strap assembly of claim 1, wherein said armpit resting portion has an inner surface and an outer surface, said armpit resting portion inner surface being for abutment against a torso, said armpit resting portion having a pocket therein, said armpit resting portion outer surface having a closeable opening into said armpit resting portion pocket.

7. The shoulder strap assembly of claim 1, wherein said waist resting portion is detachably attached to each said waist strap end portion.

8. The shoulder strap assembly of claim 7, wherein at least one of said waist strap end portions is adjustably extendible.

9. The shoulder strap assembly of claim 1, further comprising a bag, said bag being coupled to one said shoulder strap end portion by said first load attachment means, and said bag being coupled to the other said shoulder strap end portion by said second load attachment means.

10. A shoulder strap assembly for carrying a load, comprising:

an elongate shoulder strap for resting on a shoulder, said shoulder strap having a pair of opposite end portions and a padded shoulder resting portion, each said shoulder strap end portion being adjustably extendible, said shoulder resting portion being positioned between said shoulder strap end portions, said shoulder resting portion being detachably attached to each said shoulder strap end portion, said shoulder resting portion having an upper and a lower surface, said shoulder resting portion having a pocket therein, said shoulder resting portion upper surface having a closeable opening into said shoulder resting portion pocket, said shoulder resting portion lower surface being for resting on a first shoulder;

an elongate armpit strap for extending around a torso underneath a second shoulder, said armpit strap having a pair of opposite end portions and a padded armpit resting portion, at least one of said armpit strap end portions being adjustably extendible, each said armpit strap end portion being detachably attached to said shoulder strap resting portion upper surface, said armpit resting portion being positioned between said armpit strap end portions, said armpit resting portion being detachably attached to one of said armpit strap end portions, said armpit resting portion having an inner surface and an outer surface, said armpit resting portion inner surface being for abutment against a torso, said armpit resting portion having a pocket therein, said armpit resting portion outer surface having a closeable opening into said armpit resting portion pocket;

an elongate waist strap for extending around a waist underneath the second shoulder, said waist strap having a pair of opposite end portions and a waist resting portion, each said waist strap end portion being coupled to a respective one of said shoulder strap end portions, each said waist strap end portion being adjustably extendible, said waist resting portion being positioned between said waist strap end portions, said waist resting portion being detachably attached to each said waist strap end portion;

a shoulder wrap member being disposed around said shoulder resting portion, said shoulder wrap member being for providing additional padding around said shoulder resting portion;

a first load attachment means for attaching a load to one of said shoulder strap end portions; and a second load attachment means for attaching a load to the other of said shoulder strap end portions.

* * * * *